US005181927A

United States Patent [19]

Song

[11] Patent Number: 5,181,927

[45] Date of Patent: Jan. 26, 1993

[54] FRAME LOCK MECHANISM FOR A KEY LIGHT

[76] Inventor: Chang J. Song, 6740 Comstock Road, Richmond, B.C., Canada, V7C 2X6

[21] Appl. No.: 738,717

[22] Filed: Jul. 31, 1991

[51] Int. Cl.[5] ..... F24V 33/00

[52] U.S. Cl. ..... 362/116; 401/330; 701/456 R

[58] Field of Search ..... 362/116; 70/456 R, 460, 70/408, 454; 40/330

[56] References Cited

U.S. PATENT DOCUMENTS

| | | |
|---|---|---|
| D. 179,844 | 3/1957 | Gehrie . |
| 2,759,280 | 8/1956 | Schlage . |
| 2,781,594 | 2/1957 | Stupell . |
| 3,085,149 | 4/1963 | Giwosky . |
| 3,093,920 | 6/1963 | Epstein . |
| 3,209,479 | 10/1965 | Manzardo . |
| 3,310,668 | 3/1967 | Schwartz . |
| 3,349,589 | 10/1967 | Fricke . |
| 4,276,582 | 6/1981 | Burnett . |
| 4,303,966 | 12/1981 | Wolter . |
| 4,349,975 | 9/1982 | Chubb . |
| 4,392,186 | 7/1983 | Cziment . |
| 4,417,410 | 11/1983 | Freedom . |
| 4,521,833 | 6/1985 | Wolter . |
| 4,787,016 | 11/1988 | Song . |

*Primary Examiner*—Carroll B. Dority

*Attorney, Agent, or Firm*—Townsend and Townsend

[57] ABSTRACT

An indicia-holding device can be attached to a key for permitting the indicia to be associated with the key. The device for holding the indicia includes a frame having a rim which engages with the edge of a plate which covers or bears the indicia. In order to firmly attach the plate to the frame, the frame is stressed in such a manner that the rim of the frame is moved inward, effectively reducing the circumference of the frame. Stress can be induced by way of a screw, for example, by using a screw which is also used to clamp the indicia-holding device to the key. A second hole assists in removing the plate from the frame, for example, for replacement of the indicia. The indicium-bearing device can also include other key accessories such as a light.

13 Claims, 3 Drawing Sheets

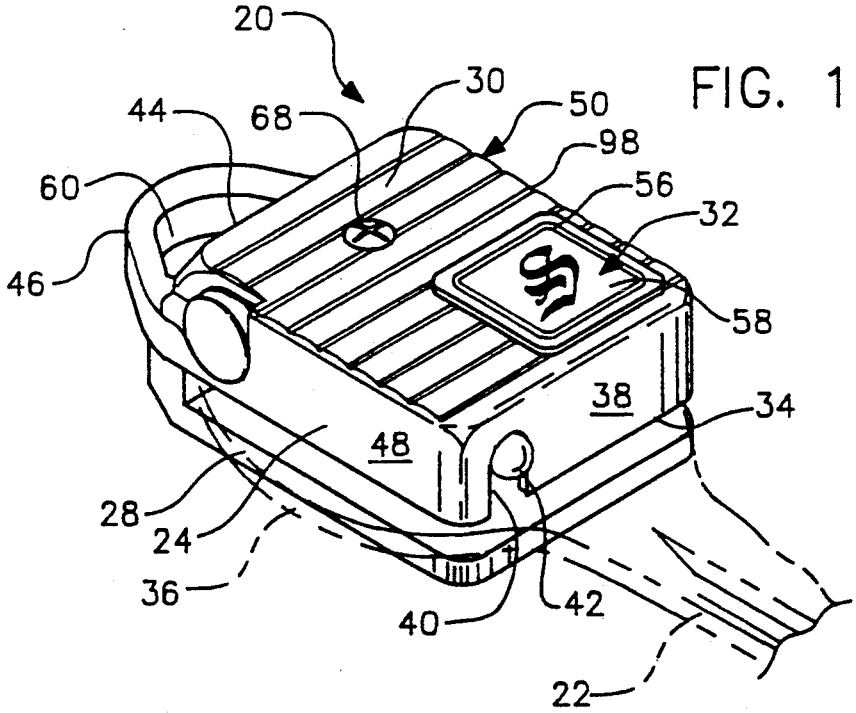
FIG. 1
FIG. 3
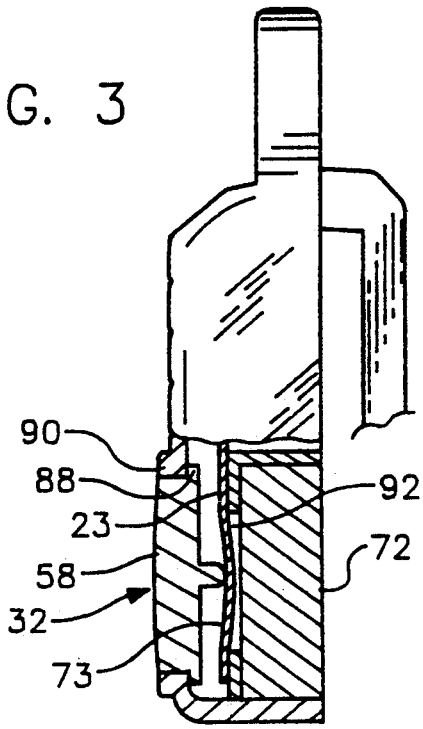

FRAME LOCK MECHANISM FOR A KEY LIGHT

BACKGROUND OF THE INVENTION

The present invention relates to a portable device for attaching indicia to a key, and more specifically, to a portable device which may be attached to a key having a head of any width and which allows indicia to be changed easily.

The attachment of indicia directly to keys has been provided in previous devices. Such indicia are attached to keys for purposes such as identification and decoration. However, previous devices had a number of disadvantages. In some devices, indicia could not be attached to keys securely. In many cases, indicia could not be changed easily. Typically, keys had to be specially formed to accommodate indicia, and indicia could not be removed from such keys without leaving a noticeable vacant area where the indicia had been attached. Indicia had to be specially formed to adapt to each particular shape and style of key, precluding the use of an indicia design for several key types and preventing interchangability of indicia among various key styles. There is a need for an inexpensive way to securely attach indicia to keys having heads of a variety of widths or other configurations, allowing indicia to be changed easily, allowing the use of a single style of indicia for many types of key, and allowing removal of such indicia without leaving a noticeable vacant area on the key.

SUMMARY OF THE INVENTION

The present invention provides a key holder for attaching indicia to a key. The holder can be used on keys with heads having a variety of widths. Preferably, the key holder also includes a light.

The key head is clamped between a body portion and frame which are held together by a screw or similar securing device. The securing device extends through a hole in the body portion, a hole in the key head and engages with a threaded hole or similar device in the frame.

The frame includes a rim portion defining a recessed region. A stress inducer is coupled to the frame. The stress inducer is preferably the securing device (e.g., the screw). Indicia are held in place, preferably beneath a transparent plate shaped to fit within the region defined by the rim. The plate and/or the indicia are secured in position by action of the stress inducer pulling the rim against the edges of the plate.

In one embodiment of the present invention, a screwdriver is provided for tightening or loosening the securing device. Preferably, the screwdriver is carried in a recess provided in the body portion. The screwdriver, when provided, allows convenient and quick installation of the key holder onto the key head, removal of the key holder from the key head, tightening of the screw securing means, and installation, removal or changing of indicia.

Preferably, the device includes a second hole through the frame, in addition to the threaded screw hole. To remove or change indicia, the screw is loosened so that the frame may be removed from the body portion. A pushing device, such as the screwdriver, if provided, may then be inserted through the second hole in the frame and pushed against the back surface of the indicia, exerting force against the indicia and/or the plate. In this way, the indicia and/or the plate may be easily removed without scratching or otherwise damaging it, allowing indicia to be removed or changed easily.

BRIEF DESCRIPTION OF THE DRAWINGS

FIG. 1 is a perspective view of an assembled key holder according to the present invention attached to a key;

FIG. 3 is a side, partial cut-away view of the body portion, showing the enclosure, battery, contact, and switch according to one embodiment of the present invention;

DESCRIPTION OF THE PREFERRED EMBODIMENT

Figure 2:
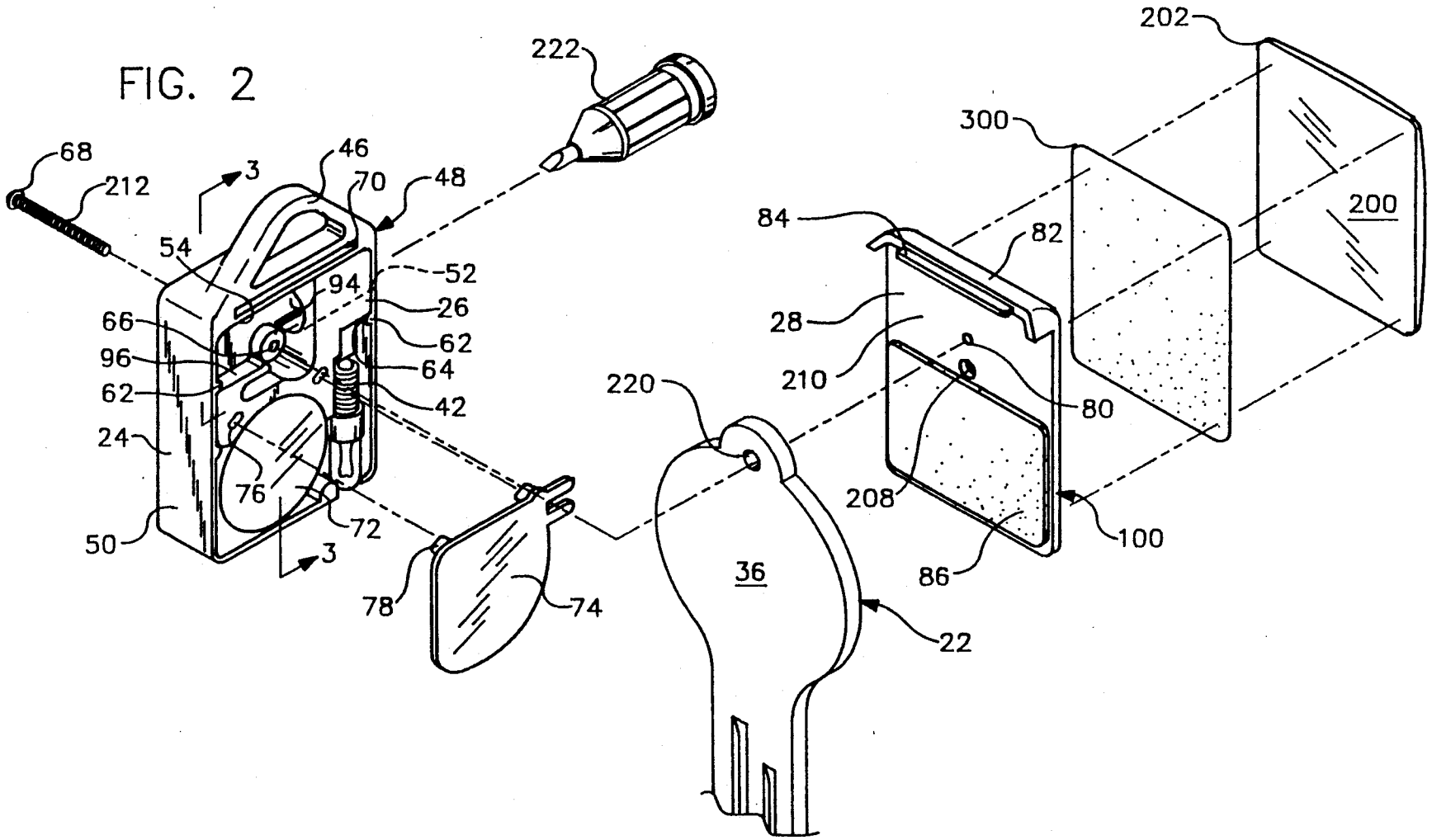
FIG. 2 is a perspective exploded view of a key holder attachable to a key according to the present invention showing internal detail and assembly of the key holder.

Referring to FIG. 1, a perspective view of an assembled key holder 20 attached to a key 22 according to the invention of the present application is shown. The key holder 20 comprises a body portion 24, an enclosure 26, a frame 28 and a plate 200.

The body portion 24 is preferably rectangular in shape. It has a front surface 30 on which, in a preferred embodiment, a switch 32 for operating a light 42 is positioned. The body portion 24 has a back surface 34 which abuts the head 36 of a key 22 when the key holder is installed on the key 22.

Referring to FIG. 2, the body portion 24 is provided with a hole 66 for receiving a securing device 68 to secure the key 22 between the body portion 24 and the frame 28. In one embodiment, the securing device 68 comprises a screw, and the hole 66 comprises a recessed bore for receiving the head of the screw such that the head lies flush with the front surface 30 of the body portion 24 (as seen in FIG. 1). In a preferred embodiment, the body portion 24 is further provided with a screwdriver for use in installing the key holder on a key and in removing the plate 200 from the frame 28, as described more completely below.

The frame 28 is preferably a generally flat rectangular plate of a size corresponding to that of the body portion 24. The frame 28 is provided with an anchoring device 80 for receiving the securing device 68 to secure the key 22 between body portion 24 and frame 28. In one embodiment, the anchoring device 80 comprises a circular bore with a helically threaded interior, designed to receive the helically threaded end of a screw. The frame 28 is provided with a raised shoulder 82 at one edge which extends from and perpendicular to the plane of the frame 28. Extending parallel to the raised shoulder 82 is a tab 84 of a size and shape designed to correspond to the size and shape of a channel 70 in the body portion 24. The frame 28 is further provided with adhesive material 86 to provide added strength to the clamping force between the body portion 24 and the frame 28 exerted on the key 22. In addition, a stress inducer 212 is provided, for which, in a preferred embodiment, the securing device 68 is used. The stress inducer extends through the body portion 24, the key 22 and engages the frame 28.

Figure 4:
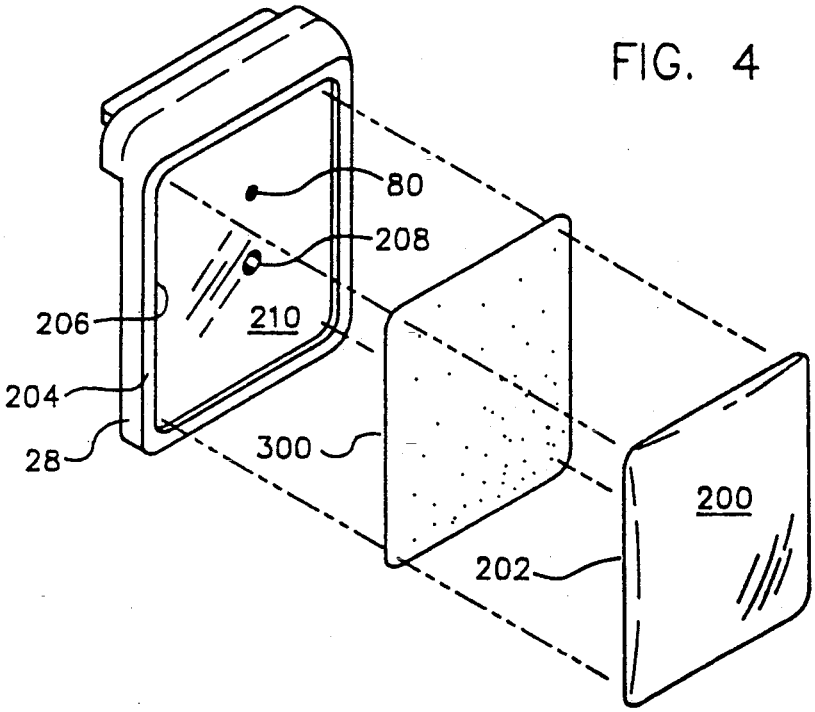
FIG. 4 is a perspective exploded view of the frame, indicium, and plate.

As seen in FIG. 4, the frame 28 is provided with a rim 204 extending perpendicular to the back surface 100 of the frame 28, defining a recessed space 206. The rim 204 is coupled to a web 210, which is coupled to the anchoring device 80. The plate 200 is shaped to fit within the space 206 with the plate edges 202 adjacent the rim 204. An indicium 300 is positioned within the space 206 between the back surface 100 of the frame 28 and the plate 200. In a preferred embodiment, the frame 28 is further provided with an access hole 208, for use in removing the plate 200, e.g., to install or remove indicia, as described below.

Figure 5:
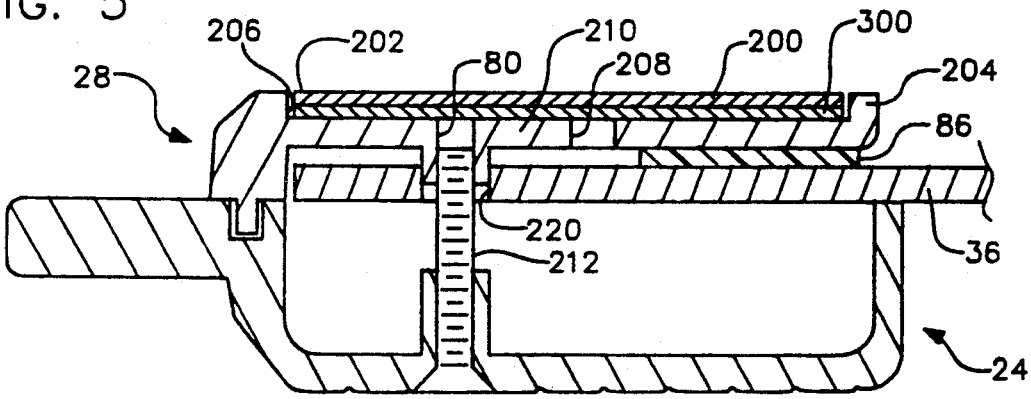
FIG. 5 is a side cut-away view of the key holder, showing the attachment of the frame to the body portion and key, before the stress inducer has been actuated.

As shown in FIG. 5, the stress inducer 212, extends through the body portion 24 and the hole 220 in the key head 36 and engages with the anchoring device 80 in the frame 28.

Figure 6:
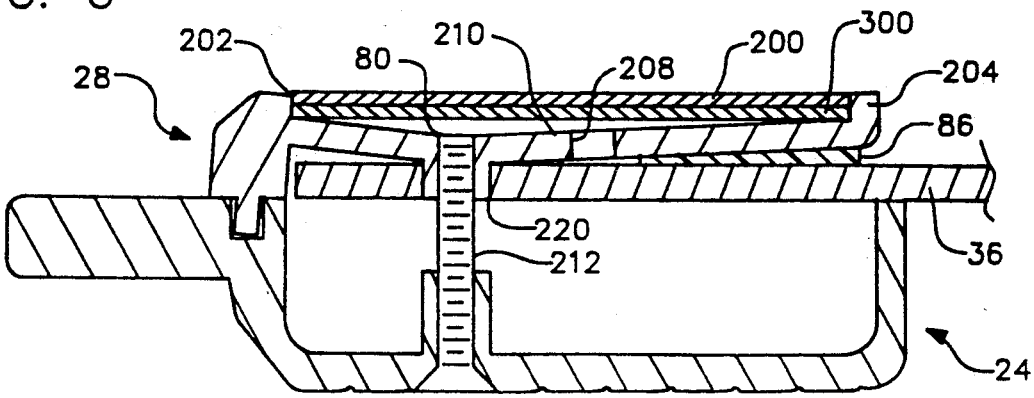
FIG. 6 is a side cut-away view of the key holder, showing, in exaggerated fashion, attachment of the frame to the body portion and key, when the stress inducer has been actuated to secure the plate.

As shown in FIG. 6, in one embodiment, the securing device 68 is tightened, pulling the web 210 of the frame 28 toward the body portion 24. The pulling of the web 210 toward the body portion 24 forces the walls of the rim 204 inward, (shown in exaggerated fashion in FIG. 6) preferably to contact the edges 202 of the plate 200, thereby securing the plate 200 to the frame 28. At the same time, the securing device 68 securely clamps the key head 36 between the body portion 24 and the frame 28. To remove or replace indicia, the securing device 68 is loosened to allow the frame 28 to be removed from the body portion 24 and the key 22. In response, the rim 204 moves outward from the edges 202 of the plate 200 because of the resiliency of the frame material. In one embodiment, a small diameter pushing device, such as the screwdriver 222, is inserted through the threaded hole 80 or, preferably, the access hole 208, to exert force against the back surface of the indicium 300, thereby assisting removal of the plate 200 from the frame 28. The indicium 300 permits the point of the screwdriver 222 to exert a force on the plate 200 without scratching or otherwise damaging plate 200.

Referring again to FIG. 2, the body portion 24 has a bottom edge 38 having, in a preferred embodiment, a bore 40 therethrough from which a light bulb 42 protrudes. The bore 40 in the bottom edge 38 is sized to allow the tip of a light bulb 42 to protrude therethrough. The bore 40, in a preferred embodiment, is "U" shaped, positioned so that the bottom edge 38 is open at the point where the bore 40 on the bottom edge 38 meets the back surface 34. The body portion 24 further has a top edge 44 from which a key chain eyelet 46 extends and two side edges 48 and 50, one of which has a bore 52, in a preferred embodiment, for receiving a screwdriver. The key chain eyelet 46 is preferably an arch shaped member extending from one side edge 48 to the other side edge 50, with a hollow passage 60 for accepting a key chain therethrough. The front surface 30 is provided with a bore 56 for receiving an actuator 58 of the switch 32. In a preferred embodiment, the bore 56 and actuator 58 are square-shaped and sized so as to allow depressing of the actuator 58 by a user's thumb or fingertip.

The back surface 34 of the body portion 24 is opened to present the cavity 54 for receiving an enclosure 26. In a preferred embodiment, the cavity 54 has a plurality of ribs 62 running between the front surface 30 and the back surface 34 of the body portion 24. These ribs 62 engage corresponding channels 64 in the enclosure 26 so as to more effectively secure the enclosure 26 in the cavity 54.

Enclosure 26, disposed in cavity 54, defines recesses for receiving a battery 72, a bulb 42, and a plurality of bulb to battery contacts 74. The recess in the enclosure 26 for receiving the battery will generally be circular to accept a circular battery, the access of the recess being perpendicular to the plane of the front surface 30. The recess for the bulb 42 preferably has ribbed sides that engage threads on the bulb to better secure the bulb in place. The recesses for the contacts 74 may comprise either channel-like recesses into which the entire contact is fit, or in a preferred embodiment, the recesses comprise one or more rectangular notches into which are fit correspondingly shaped holes 76 located on the contacts 74.

As discussed above, the side edge 48 of the body portion 24 is provided with a bore 52 for receiving a screwdriver. The enclosure 26, in this embodiment, will have a correspondingly shaped and positioned channel 94 for receiving the screwdriver. Additionally, the enclosure 26 is provided with a biased retaining tab 96 which engages a complimentary portion of the screwdriver, when the screwdriver is disposed in the recess, for holding the screwdriver in place.

In one embodiment of the present invention, an eyelet of large diameter is provided to allow installation of the key holder onto a wide variety of key carrying chains and rings. Further, the frame and switch actuator can be fabricated of a metal, such as aluminum, for greater durability.

Referring in particular to FIG. 3, details of a switch 32 are shown. The switch 32 comprises a button-like actuator 58 disposed in corresponding bore 56 in the body portion 24. The actuator 58 is held in place in the bore 56 by a biased contact 74 which biases a flanged collar 88 of the switch actuator 58 against a corresponding shoulder 90 on the body portion 24. The contact 74 which biases the switch actuator 58 is proximate to, but not in touching engagement with the battery 72. A device 92 is provided in the enclosure 26 to allow touching engagement between the contacts 73 and the battery 72 when the switch actuator 58 is depressed against the biasing force of the contact 74. When such contact is made, a circuit between the battery 72 and the light bulb 42 is complete, thus the light bulb 42 is illuminated.

The material from which the body portion 24, enclosure 26, frame 28, indicium 300 and plate 200 are made may vary. In one embodiment of the present invention, the body portion 24 and frame 28 are fabricated of metallic material such as aluminum or alloy. Also, the enclosure 26, in a preferred embodiment, is fabricated of plastic. In other embodiments, the body portion 24 and frame 28 may be of plastic material or the enclosure 26 may be of a metallic material. Preferably, the frame is made of a material having resilience. Likewise, the material from which the switch actuator 58 may be fabricated may vary, wherein a preferred embodiment, the switch actuator 58 is a metallic material such as aluminum or alloy. Other embodiments have a switch actuator 58 fabricated of plastic. The plate 200 may be of a variety of materials, but in a preferred embodiment is of transparent plastic so that indicia 300 are visible beneath the plate 200. The indicium 300 is, in a preferred embodiment, of paper or plastic but may be of virtually any flat material which can be shaped to fit within the space 206 between the frame 28 and plate 200. The indicium can bear any desired device or design including, without limitation, room or location information, geographic indicia, logos, political messages and the like.

To provide improved gripping of the key holder a plurality of parallel notches or similar contours 98 are provided on the front surface 30 of the body portion 24. Generally, notches or contours 98 will extend the width of the body portion 24 in a direction perpendicular to the axis of the key 22.

In use, the key holder 20 is attached to the key 22 in the following manner. The screwdriver 222 is removed from its recess and used to loosen the screw 68. If it is desired to change the indicium 300, the screwdriver 222 is inserted through the second hole 208 and pushed against the indicium 300 thus facilitating the removal of the plate 200 from the space 206. A new indicium 300 is placed in the space 206 and the plate 200 is reinstalled in the space 206. The head of the key 36 is positioned between the frame 28 and the body portion 24 with the keyhole 220 aligned with the holes 80, 66. The screw 68 is rotated to engage the threaded hole 80 thus clamping the key 36 between the frame 28 and the body portion 24, as shown in FIG. 5. The screw 68 is further rotated to pull the web 210 of the frame 28 towards the body portion 24, causing the rim 204 of the frame 28 to move inwardly with respect to the space 206 thus exerting a clamping force of the rim 204 on the edge 202 of the plate 200, as depicted, in exaggerated form, in FIG. 6.

In view of the above description, a number of advantages of the present invention can be seen. Indicia can be attached to the keys securely, yet the indicia can be easily changed by the user. The key holder can be used with a variety of keys so that the keys do not need to be specially formed in order to accommodate the indicia. The indicia can be removed without leaving a vacant area on the key where the indicia had been attached. The indicia can be of any form having a suitable size and do not need to be specially formed in order to adapt to or attach to a particular shape or style of key.

Although the present device has been described by way of a preferred embodiment, various modifications and alterations can also be used. Certain aspects of the disclosed invention can be provided without using other aspects. For example, it is possible to use the frame-clamping mechanism without providing a light. The frame, shown as having a rim completely surrounding the indicia could be provided with two or more arms for grasping the plate at selected points, rather than around the entire edge thereof. Similarly, the plate could be provided with one or more protrusions for engagement with a frame section, for example only at the protrusion locations. The plate could be provided in opaque rather than transparent form, which case the plate could, itself, bear the indicia rather than being a cover for an indicia mounted underneath the plate. Plate-engaging stress can be induced by a pushing force rather a pulling force, with suitable modification of the coupling between the plate and the frame. The stress-inducing force can be provided by means other than a screw, including a latch means, a lever means, a spring means and the like. A number of materials can be used for the indicium including, photographs, postage stamps, and other decorative items as well as sheets bearing utilitarian information such as room numbers, advertising, and the like. The key holder can be provided with a frame and plate but without indicia so that a purchaser or user can supply his own preferred indicia or decoration. The edge of the plate can be tapered to provide for positive engagement between the stress-flexed frame and the edge of the plate in which case the smallest perimeter defined by the rim will be smaller than the largest perimeter defined by the plate.

Although the present invention has been described by way of a preferred embodiment and various modifications and variations, other modifications and variations can also be used, the invention being described by the appended claims.

What is claimed is:

1. In a key holder, apparatus for use in displaying, comprising:

a body portion of the key holder;

a frame, coupled to said body portion, said frame including a web portion and a rim portion, coupled to said web portion;

a plate, configured for engagement with said rim portion; and a stress-inducer coupled to said body portion and to said frame wherein said rim portion is configured to move in response to stress induced by said stress-inducer so as to engage with said plate.

2. Apparatus, as claimed in claim 1, wherein said key holder includes a light source.

3. Apparatus, as claimed in claim 1, wherein said stress-inducer includes a screw extending between said body and said frame.

4. A key light comprising:

a body portion, attachable to a key, said body portion including a light source and having at least a first hole therethrough;

a frame including a surface having a threaded hole and a rim coupled to said surface, said rim defining a first space;

a plate, having an edge, said plate configured to fit within said first space;

a screw inserted through said first hole of said body portion and engaging said threaded hole of said surface so as to pull said surface toward said body portion and move said rim inwardly into said space to form an engagement with said edge of said plate.

5. A key light, as claimed in claim 4, wherein said engagement is a frictional engagement.

6. A key light, as claimed in claim 4, wherein said engagement includes configuration of said rim so as to define a perimeter equal to or smaller than the perimeter of said plate.

7. An ornament for a key comprising:

a frame having a rim, said rim defining a first space;

a plate, having an edge, positionable within said first space;

means for moving said rim between a first configuration permitting removal of said plate from said first space, and a second configuration preventing removal of said plate from said first space; and means for attaching said frame to said key.

8. An ornament, as claimed in claim 7, wherein said means for attaching includes a base portion and wherein said means for moving includes a screw which attaches said base portion to said frame.

9. A key holder comprising:

a body portion, attachable to a key, said body portion having at least a first hole therethrough;

a frame including a surface having a threaded hole and having a rim coupled to said surface, said rim defining a first space;

a plate, having an edge, said plate configured to fit within said first space;

a screw inserted through said first hole of said body portion and engaging said threaded hole of said surface so as to attach said body portion to said frame; and opening means in said frame for receiving an instrument for pushing on said plate to remove said plate from said first space.

10. A key holder, as claimed in claim 9, wherein said opening means comprises said threaded hole.

11. A key holder, as claimed in claim 9, wherein said opening means comprises a hole in said frame different from said threaded hole.

12. A key holder, as claimed in claim 9, further comprising means for preventing scratching of said plate by said instrument.

13. A key holder, as claimed in claim 9, wherein said means for preventing scratching comprises a paper sheet.

* * * * *